US007401862B2

(12) United States Patent
Holl et al.

(10) Patent No.: US 7,401,862 B2
(45) Date of Patent: Jul. 22, 2008

(54) CONSTRUCTION MACHINE

(75) Inventors: Bernd Holl, Neustadt (DE); Günter Hähn, Königswinter (DE); Martin Lenz, Grossmaischeid (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 10/564,222

(22) PCT Filed: Apr. 15, 2004

(86) PCT No.: PCT/EP2004/003940

§ 371 (c)(1),
(2), (4) Date: Jun. 30, 2006

(87) PCT Pub. No.: WO2005/005119

PCT Pub. Date: Jan. 20, 2005

(65) Prior Publication Data

US 2007/0132304 A1 Jun. 14, 2007

(30) Foreign Application Priority Data

Jul. 14, 2003 (DE) ..... 103 31 970

(51) Int. Cl.
*E21C 35/18* (2006.01)

(52) U.S. Cl. ..... 299/39.6; 299/106; 299/95

(58) Field of Classification Search ..... 299/39.4, 299/39.6, 39.8, 100, 106, 95
See application file for complete search history.

(56) References Cited

U.S. PATENT DOCUMENTS

| | | | | |
|---|---|---|---|---|
| 3,342,531 A | | 9/1967 | Krekeler | |
| 4,329,766 A | * | 5/1982 | Leonard et al. | 29/254 |
| 4,337,980 A | * | 7/1982 | Krekeler | 299/102 |
| 5,438,860 A | | 8/1995 | Kawai et al. | |
| 5,498,069 A | * | 3/1996 | Siebenhofer et al. | 299/81.3 |
| 2004/0021364 A1 | * | 2/2004 | Busley et al. | 299/39.4 |

FOREIGN PATENT DOCUMENTS

| | | |
|---|---|---|
| DE | 30 26 930 A1 | 10/1981 |
| DE | 32 23 761 C2 | 12/1983 |
| DE | 39 03 482 A1 | 8/1990 |
| DE | 39 35 691 A1 | 5/1991 |
| DE | 93 10 542.8 | 1/1994 |
| DE | 195 12 349 C1 | 4/1995 |
| DE | 296 23 508 U1 | 9/1998 |
| DE | 100 44 369 A1 | 4/2002 |
| EP | 1 013 829 A2 | 6/2000 |
| EP | 1 167 626 A1 | 1/2002 |
| WO | 97/23710 | 7/1997 |

* cited by examiner

*Primary Examiner*—John Kreck
(74) *Attorney, Agent, or Firm*—Pauley Petersen & Erickson

(57) ABSTRACT

A construction machine for machining floor surfaces, wherein the machine includes a milling roll having a plurality of tool holders on a surface thereof. A tool, especially a straight shank tool, is received in a tool receiving element of the tool holder in an exchangeable manner. With this invention it is possible to change the tool in one such construction machine in a simplified manner. Thus, the milling roll is associated with a tool changing device, and the tool changing device dismounts each tool from the tool holder and/or mounts each tool in the tool holder.

21 Claims, 5 Drawing Sheets

CONSTRUCTION MACHINE

BACKGROUND OF THE INVENTION

1. Field of the Invention

This invention relates to a construction machine for working pieces of ground, having a milling roller on which surface chisel holders are arranged, wherein a chisel, in particular a round shaft chisel, is exchangeably received in a chisel receiver of the chisel holder.

2. Discussion of Related Art

A construction machine designed as a road-milling machine is taught by German Patent Reference DE 39 03 482 A1. Road coverings can be cut off by road-milling machines. The chisels continuously wear out during operation of the machine. After the chisels have reached a certain wear state, they must be replaced. Thus it is necessary for a worker to approach the milling roller and there drive the chisels out of the chisel holders. For driving the chisels out, the worker uses a special ejection mandrel and a hammer. This can lead to injuries. Manipulation in the narrow milling roller area is extremely difficult and requires great care in order to reduce the risk of danger. After a chisel is removed from its chisel holder, it is necessary to insert fresh unworn chisels into the chisel holders. Replacement of the chisels is a very arduous and time-consuming job.

Manually operable exchangeable tools are known from German Patent Reference DE 32 23 761 C2 and from U.S. Pat. No. 3,342,531. They have a shoulder, which positively engages a circumferential groove in the chisel. The chisels can then be levered out of the associated chisel holder. Although the exchange process is easier with this, working on the milling roller is nevertheless dangerous and arduous.

SUMMARY OF THE INVENTION

It is one object of this invention to provide a road-milling machine of the type mentioned above but wherein the exchange of the chisels is simplified.

This object is achieved with a tool changing device assigned to the road-milling machine, and the tool changing device removes and/or mounts each chisel from or in the chisel holder.

Thus, in accordance with this invention a changing tool is proposed, which automatically removes the worn chisel and/or mounts an unworn chisel in the chisel holder receptacle of the chisel holders. Thus it is possible to reduce manual labor necessary for changing the chisels. Because the changing process is at least partially automated, it can be more rapidly performed, so that fewer machine outages are created. Also, with the device in accordance with this invention, the endangerment of the health and the stress on the body of the machine operator are reduced.

The tool changing device preferably is a mechanical tool device. It is arranged inside or outside of the milling roller. Different concepts can be used, depending on the intended use, during the technical layout of the tool changing device.

The tool changer can be positioned in relation to the chisel. The chisel can be positioned in relation to the tool changer. The tool changer and the chisel can be positioned with respect to each other.

In some embodiments, the tool changing device has at least one tool changer, which can be assigned to the individual chisel holders or groups of chisel holders by an actuating unit. It is also possible for a single tool changer to be mutually assigned to all chisels or chisel holders. It then removes or installs the chisels simultaneously. In an alternative embodiment of this invention, a tool changer of the tool changing device is respectively assigned to each chisel holder, and the tool changers are fixedly connected with the chisel holder. The tool changers can be connected with each other by a common control device. A machine operator can, for example, purposefully change individual chisels, groups of chisels, or all chisels together with this control device.

In another embodiment, the tool changing device imparts at least one dynamic pulse opposite the removal direction of each chisel to the milling roller, a portion of the milling roller, the chisel holder or a group of chisel holders. Thus, a pulse is generated by the tool changing device, which imparts an ejection force to the chisel because of the mass inertia of the chisel. The pulse can be built up, for example, by a vibration generated in the milling roller. It is also possible to provide one or several vibration devices. In a further embodiment, a pulse generator is employed on the milling roller. Thus it is possible, for example, to assign a stop to the milling roller, which has a contact face pointing in the work movement direction. A pulse generator creates a force on the contact face which is directed opposite the work movement direction. The pulse generator can be a mallet, which acts with its weight on the contact face.

As explained above, the tool changing device can be such that the chisel is positioned in relation to the tool changer. Positioning of the chisel can take place, for example, by a displacement device, which positions the milling roller in relation to the tool changer. In accordance with another embodiment of this invention, this can take place so that the milling roller is coupled with a drive motor of the construction machine by a drive train. A displacement device can have an auxiliary drive which can be coupled with the drive train and which turns the milling roller in the raised position by a predetermined or selectable angle of rotation. A torque of the auxiliary drive can be greater than the inertia of the milling roller and of the portion of the drive train moving together with the milling roller when the drive motor is switched off or uncoupled. During this it is possible to use the preset position pattern of the chisels and to store it in a control device. The actuating unit and/or the displacement device can have a position measuring system, and the actuating unit and/or the displacement device can be equipped with a numerical control.

In this case the layout of the tool can be such that the actuating unit positions the at least one tool changer in relation to the milling roller. During this the tool changer and the milling roller are brought into positions with respect to each other.

It is possible for tool changers to be arranged fixed in place on the machine. The chisels are then assigned to them by rotation of the milling roller.

The tool changer can be laid out so that it engages the chisel in a positive or non-positive manner and removes it from the chisel holder or installs it in the chisel holder.

The tool change can be further automated if the tool changing device conveys the removed chisels directly, or via a conveying device, to a container, or if a separating device is assigned to the tool changing device. The separating device conveys chisels from a storage unit to the tool changing device.

It is possible to optimize tool down time if a detection device is assigned to the milling roller, which checks the wear state of the chisels, or of a portion of the chisels, or of a single chisel, continuously, at intervals, or when directed, and if the detection device initiates or signals a tool change upon reaching a predetermined wear state.

For example, the wear detection can be designed so that at least one signal reception unit of the detection device is assigned to at least one structural unit of the machine which directly or indirectly participates in the working process. The signal reception unit detects an operational state of the structural unit of the machine, and the signal reception unit determines the wear state via a signal processing arrangement.

BRIEF DESCRIPTION OF THE DRAWINGS

This invention is described in view of the drawings, wherein.

DESCRIPTION OF PREFERRED EMBODIMENTS

Figure 1:
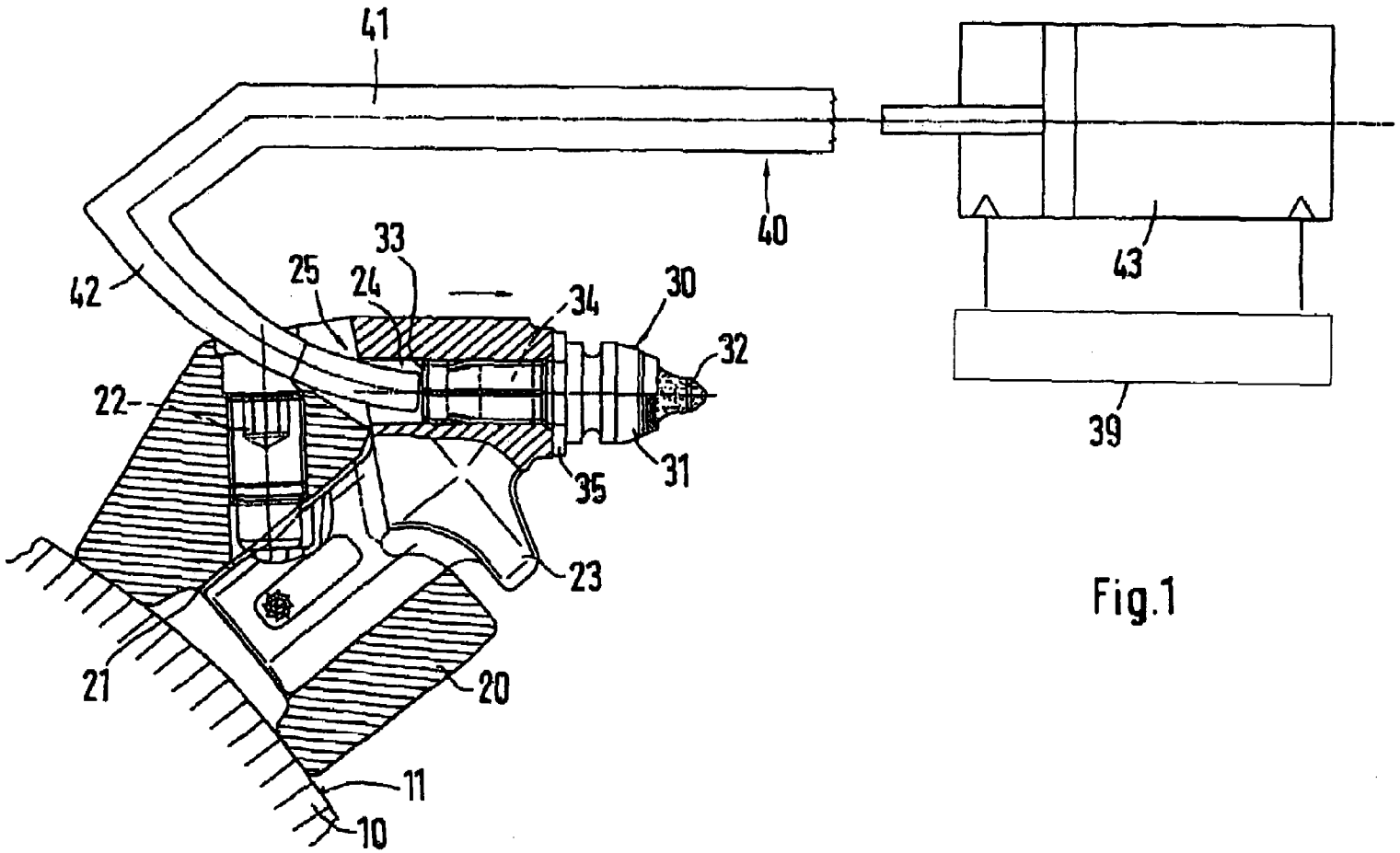
FIG. 1 is a lateral view and a partial representation of a milling roller of a road-milling machine with a chisel holder mounted thereon and with a tool changing device.

A rotary body of a road-milling machine, namely a milling roller 10, is represented in FIG. 1. Base elements 20 are arranged in a systematic separation from each other on the roller surface 11 of the milling roller 10. The base elements 20 are connected, preferably welded, to the roller surface 11. The base elements 20 each has a plug-in receiver 21. A plug-in shoulder of a chisel holder 23 can be inserted into the plug-in receiver 21. The chisel holder 23 is fixed on the base element 20 by a pressure screw 22. The chisel holder 23 has a chisel receiver 24, which is embodied as a bore in the present case. A chisel 30, here a round shaft chisel, can be inserted into the bore. The chisel 30 has a chisel head 31, to the front of which a chisel tip 32, comprising a hard alloy or a ceramic material, is fastened. A shaft 33, on which a clamping sleeve 34 is drawn, adjoins the chisel head 31. The clamping sleeve 34 is connected with the shaft 33 so that it is not axially displaceable, but rotatable in the circumferential direction.

The chisel head 31 rests on a counter-surface of the chisel holder 23, with a wear-protection disk 35 placed between them.

As shown in FIG. 1, a tool changing device with a tool changer 40 is assigned to the chisel holder 23. The tool changer 40 has an actuating motor 43 driving a transfer member 41. In this case, the transfer member 41 is designed as a draw bar. On the end facing away from the actuating motor 43, the transfer member 41 has an ejection mandrel 42. The ejection mandrel 42 can be introduced into the chisel receiver 24 by the actuating motor 43. Here, the mandrel penetrates the chisel receiver 24 through the rear bore opening 25 and then encounters the rear impact face formed by the shaft 33. The actuating motor 43 pulls the ejection mandrel 42 into the chisel receiver 24. In the process, the chisel 30, together with its clamping sleeve 34, is pushed out of the chisel receiver 24. After the chisel 30 is moved out of the chisel receiver 24, the actuating motor 43 pushes the ejection mandrel 42 out of the chisel receiver 24, again.

The tool changer 40 can be displaced, for example linearly, in the direction of the center longitudinal axis of the milling roller 10 by an actuating unit 39. It then can be assigned to the individual chisel holders 23 of the milling roller 10, one after the other. Advantageously, the actuating motor 43 does not only move one ejection mandrel 42, but moves several ejection mandrels 42 simultaneously, so that several chisels 30 can be pushed out of their chisel holders 23 in one actuating process.

It is also possible for the milling roller 10 to be rotated by an auxiliary drive mechanism of a displacement device 37. The auxiliary drive mechanism can be operated when the milling roller 10 is lifted off the ground. It can then be displaced for a tool change by the auxiliary drive mechanism. A control unit can also be assigned to the auxiliary drive mechanism. It rotates the milling roller 10 in accordance with a preset program run, so that the chisels 30, or a portion of the chisels 30, can be oriented with respect to the tool changer 40.

Figure 2:
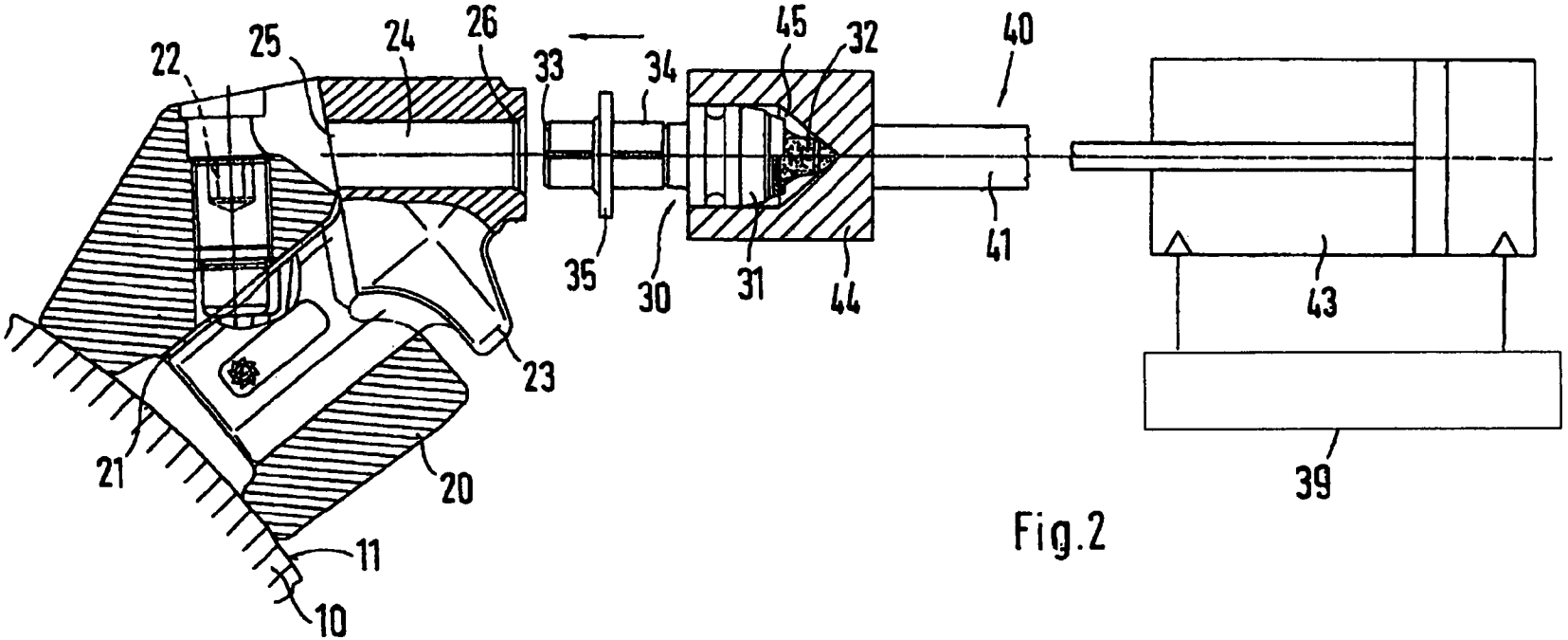
FIG. 2 is a lateral view and a partial representation of the milling roller in accordance with FIG. 1, with a tool changing device for installing unworn chisels.

A tool changer 40, which is used for installing an unworn chisel 30 into the chisel receiver 24, is represented in FIG. 2. Again, the tool changer 40 has an actuating motor 43, which linearly displaces the transfer member 41. The transfer member 41 has an assembly bell 44 with a receiver 45, in which the chisel head 31 of the chisel 30 to be installed is maintained. Accordingly, the tool changer 40 is assigned to the chisel holder 23 by an actuating unit. Thus, the chisel shaft is located opposite the bore entry into the chisel receiver 24. Thereafter the actuating motor 43 is activated. The shaft 33 is then pushed into the chisel receiver 24. The threading movement of the shaft 33 into the chisel receiver is made easier by a conical bore widening 26. After the chisel 30 is installed in the chisel holder 23, the chisel head 31 is released from the assembly bell 44. The actuating motor 43 again moves into its initial position and is then available for the next installation process.

The tool changers represented in FIGS. 1 and 2 can be used individually or together in a road-milling device. If they are used together, a fully automatic chisel change can be performed.

Figure 3:
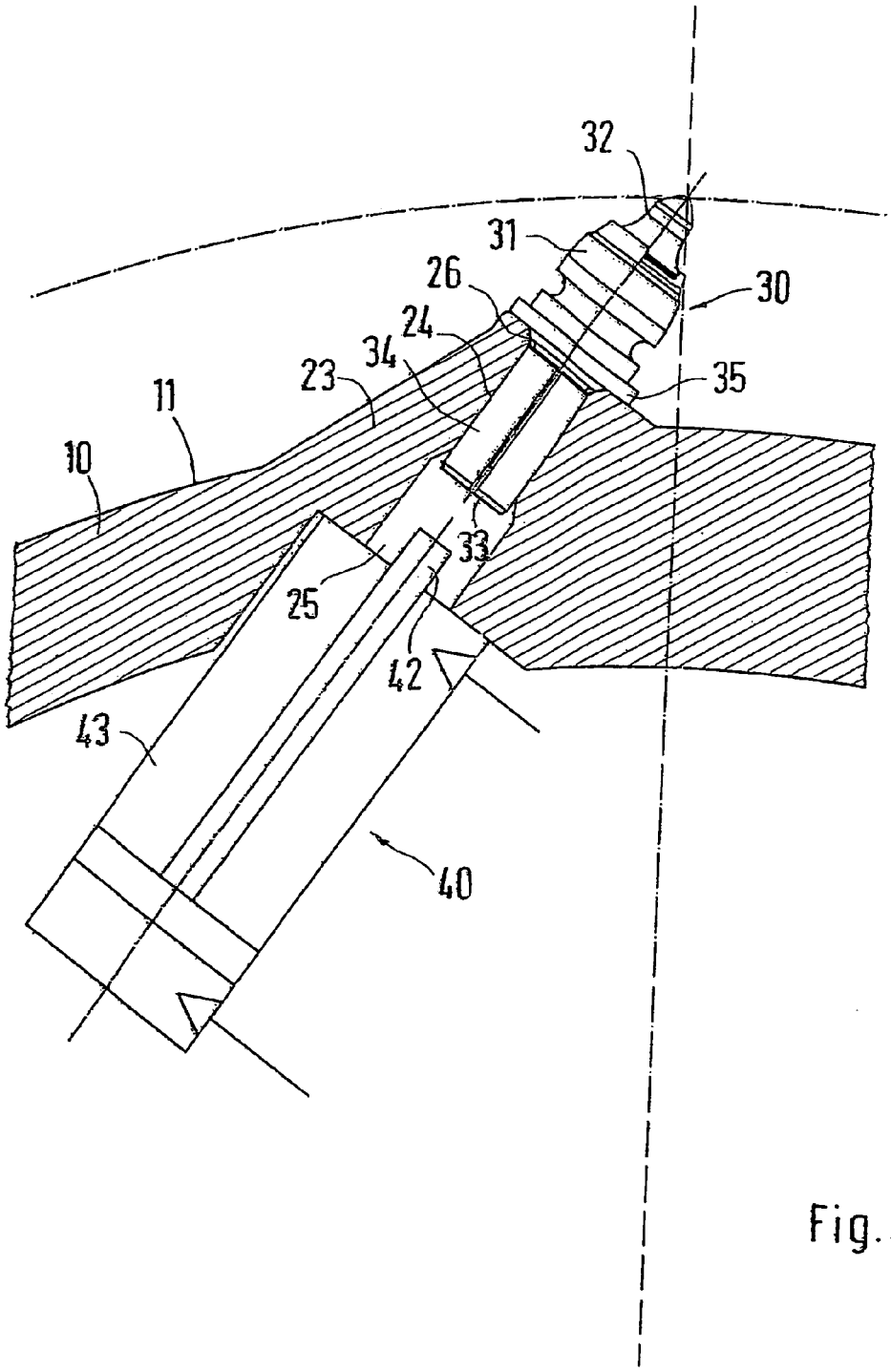
FIG. 3 shows a milling roller with a chisel holder formed on it in one piece, in a sectional lateral view.

A portion of a milling roller 10 is represented in FIG. 3. The milling roller 10 has a milling roller tube, which forms the roller surface 11. Chisel receivers 24 are directly cut into the milling roller tube, so that the chisel receivers 24 are connected in one piece with the milling roller tube. The chisel receiver 24 is formed by a bore having a bore end with a bore widening 26, which makes the insertion of the chisel 30 easier. A tool changer 40 is arranged at the other end of the bore and can be embodied as a hydraulic or a pneumatic cylinder and can have a linearly displaceable ejection mandrel 42. It is possible to employ the tool changing device represented in FIG. 3 in any arbitrary, different chisel holder system, such as in a changer holder system as represented in FIGS. 1 and 2. A chisel 30 is inserted into the chisel receiver 24 and in its structural type, it corresponds to the chisels 30 represented in FIGS. 1 and 2.

The tool changer 40 is activated for removing the chisel 30 from its chisel receiver 24. The ejection mandrel 42 then moves against the free end of the chisel shaft 33. The ejection mandrel 42 ejects the chisel 30 in the direction of the center longitudinal axis of the chisel receiver 24. The tool changer can also be used to again install a fresh unworn chisel 30 into the chisel receiver 24. Thus, the chisel 30 can be connected with the extended ejection mandrel 42 and can be pulled into the chisel receiver 24 with the aid of the changing tool 40.

Figure 4:
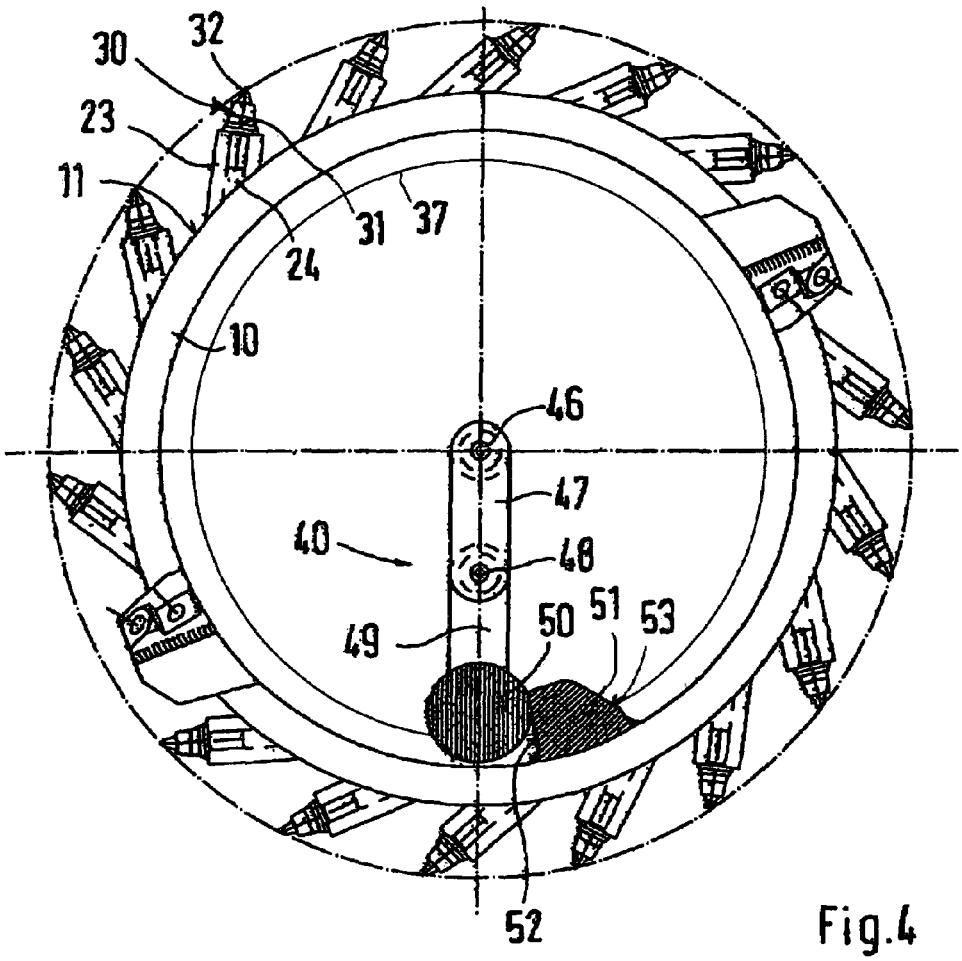
FIG. 4 shows a milling roller with a tool changing device in the milling roller interior, in a lateral view.
Figure 5:
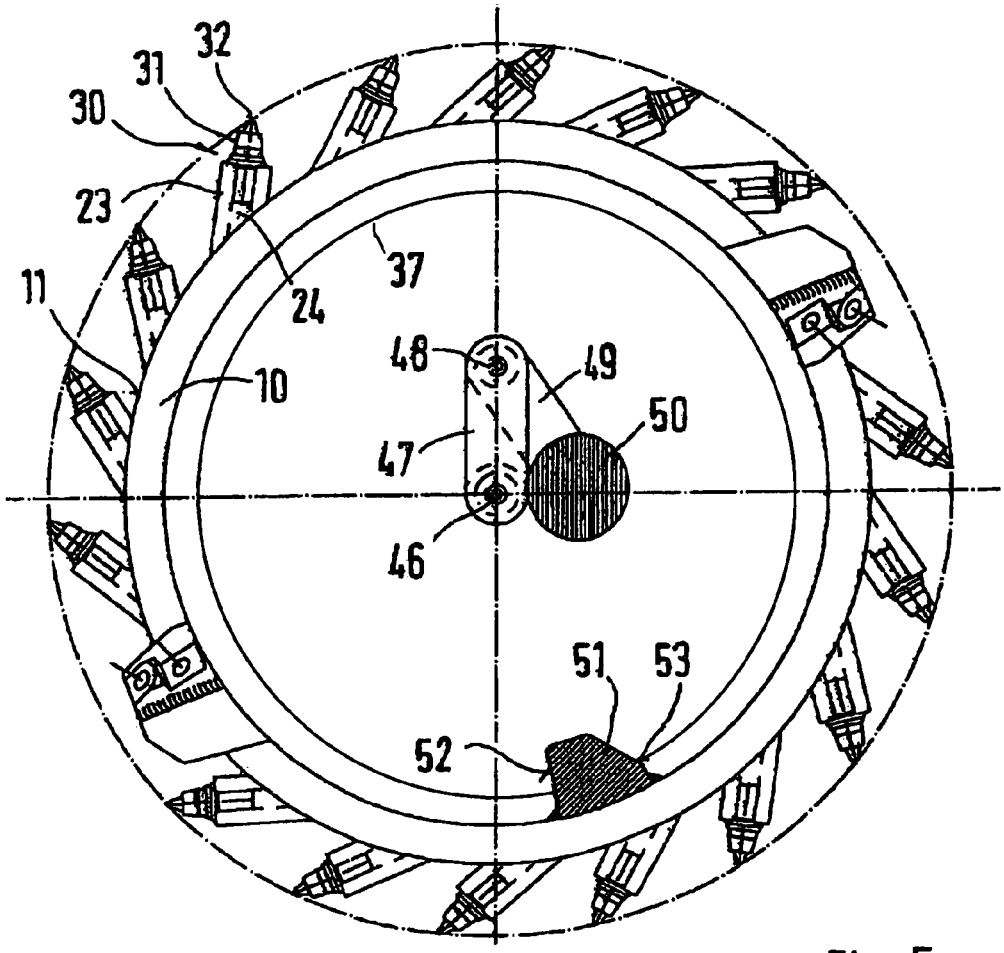
FIG. 5 shows the representation in accordance with FIG. 4, in a changed work position.

A further embodiment variation of a milling roller 10 with a tool changing device is described in FIGS. 4 and 5. The tool changing device has a tool changer 40 housed in the interior of the milling roller 10. The milling roller 10 is constructed similar to the milling roller 10 shown in FIG. 3. It has chisel holders 23 formed on it in one piece. It is possible to employ any arbitrarily differently designed chisel holder 23.

The tool changer 40 has two articulated arms 47, 49, which are connected with each other by a hinge 48. The articulated arm 47 is fixed in place via a hinge 46. A pulse generator 50 in the form of a weight is arranged at the free end of the second articulated arm 49. On its interior circumference, the milling roller 10 has a stop 51 with a contact face 52. On the side facing away from the contact face 52, the stop 51 has an inclined deflection face 53.

During normal milling operations, the tool changer 40 is maintained in the position represented in FIG. 5. If a chisel change is due, it is moved into the position shown in FIG. 4. Then the milling roller 10 is rotated in the circumferential direction until the pulse generator 50 impacts on the inclined deflection face 53 of the stop 51. A pulse is thus generated, which acts opposite to the removal direction of the chisels 30. Because of this pulse a force is introduced into the chisels 30 which pushes them out of the chisel receivers 24.

After the pulse generator 50 has impacted the contact face 52, it is deflected at the stop 51 and is again brought into its extended initial position via the inclined deflection face 53. If needed, the process for generating a pulse can then be repeated. At the termination of the ejection process the tool changer 40 is again returned into the position represented in FIG. 5. A reversal of the action principle is also possible and the pulse generator can be rotated.

The invention claimed is:

1. A construction machine for working pieces of ground, having a milling roller (10) with a surface with a plurality of arranged chisel holders (23), wherein a chisel (30), including a round shaft chisel, is exchangeably received in a chisel receiver (24) of the chisel holder (23), the construction machine comprising:

a tool changing device in combination with the milling roller (10), wherein the tool changing device at least one of removes the chisel (30) from the chisel holder (23) and installs the chisel (30) in the chisel holder (23), and a displacement device positioning one of the milling roller (10) and the chisel (30) relative to at least one tool changer (40), and an actuating unit positioning the at least one tool changer (40) relative to the chisel (30) along a center longitudinal axis of the milling roller (10).

2. The construction machine in accordance with claim 1, wherein the tool changing device is a mechanical tool device.

3. The construction machine in accordance with claim 1, wherein the tool changing device is arranged in an interior of the milling roller (10).

4. The construction machine in accordance with claim 1, wherein the tool changing device is arranged outside of the milling roller (10).

5. The construction machine in accordance with claim 1, wherein the tool changing device has at least one tool changer (40) for removal of the chisel (30) from one or more than one of the individual chisel holders (23), by the actuating unit.

6. The construction machine in accordance with claim 1, wherein the tool changing device has a single tool changer (40) for use with each of the chisels holders (23).

7. The construction machine in accordance with claim 1, further comprising a tool changer (40) of the tool changing device for each of the chisel holders (23).

8. The construction machine in accordance with claim 1, wherein a torque of the displacement device is greater than an inertia of the milling roller (10).

9. A construction machine for working pieces of ground, having a milling roller (10) with a surface with a plurality of arranged chisel holders (23), wherein a chisel (30), including a round shaft chisel, is exchangeably received in a chisel receiver (24) of the chisel holder (23), the construction machine comprising:

a tool changing device in combination with the milling roller (10), wherein the tool changing device at least one of removes the chisel (30) from the chisel holder (23) and installs the chisel (30) in the chisel holder (23), the tool changing device imparting a dynamic pulse to at least one of the milling roller (10), a portion of the milling roller (10), the chisel holder (23), and a group of chisel holders (23), the dynamic pulse being imparted in a direction opposite the removal direction of the chisel (30), and with a mass inertia of the chisel (30) the pulse introducing an ejection force in the chisel (30).

10. The construction machine in accordance with claim 9, wherein the tool changing device is a mechanical tool device.

11. The construction machine in accordance with claim 10, wherein the tool changing device is arranged in an interior of the milling roller (10).

12. The construction machine in accordance with claim 10, wherein the tool changing device is arranged outside of the milling roller (10).

13. The construction machine in accordance with claim 12, wherein the tool changing device has at least one tool changer (40) for removal of the chisel (30) from one or more than one of the individual chisel holders (23), by an actuating unit.

14. The construction machine in accordance with claim 13, wherein the actuating unit positions the at least one tool changer (40) relative to the milling roller (10).

15. The construction machine in accordance with claim 12, wherein the tool changing device has a single tool changer (40) for use with each of the chisels holders (23).

16. The construction machine in accordance with claim 12, further comprising a tool changer (40) of the tool changing device for each of the chisel holders (23).

17. The construction machine in accordance with claim 9, wherein the dynamic pulse is generated by a vibration device.

18. The construction machine in accordance with claim 9, wherein at least one stop (51) is assigned to the milling roller (10) which has a contact face (52) pointing in a work movement direction, and a pulse generator (50) creates a force on the contact face (52) which is directed opposite the work movement direction.

19. The construction machine in accordance with claim 18, wherein the pulse generator (50) is a mallet which acts with a weight on the contact face (52).

20. The construction machine in accordance with claim 19, wherein a torque of the displacement device is greater than an inertia of the milling roller (10).

21. The construction machine in accordance with claim 20, wherein the actuating unit positions the at least one tool changer (40) relative to the milling roller (10).

* * * * *